US011299987B2

(12) United States Patent
Grief et al.

(10) Patent No.: US 11,299,987 B2
(45) Date of Patent: Apr. 12, 2022

(54) HEADING MACHINE WITH CUSP CUTTER

(71) Applicant: SANDVIK MINING AND CONSTRUCTION G.M.B.H., Zeltweg (AT)

(72) Inventors: Ralf Grief, Weisskirchen in Steiermark (AT); Stefan Hasler, WeiBkirchen (AT); Karl Irregger, Weisskirchen (AT); Stefan Steiner, Polstal (AT); Gerhard Weinberger, Zeltweg (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 0 days.

(21) Appl. No.: 16/965,558

(22) PCT Filed: Jan. 31, 2018

(86) PCT No.: PCT/EP2018/052413

§ 371 (c)(1),
(2) Date: Jul. 28, 2020

(87) PCT Pub. No.: WO2019/149354

PCT Pub. Date: Aug. 8, 2019

(65) Prior Publication Data

US 2021/0047926 A1 Feb. 18, 2021

(51) Int. Cl.

| | |
|---|---|
| ***E21C 27/12*** | (2006.01) |
| ***E21C 27/22*** | (2006.01) |
| ***E21C 27/24*** | (2006.01) |

(52) U.S. Cl.

CPC ..... *E21C 27/124* (2013.01); *E21C 27/22* (2013.01); *E21C 27/24* (2013.01)

(58) Field of Classification Search

CPC ..... E21C 27/22; E21C 27/24; E21C 27/124
See application file for complete search history.

(56) References Cited

U.S. PATENT DOCUMENTS

| | | | | |
|---|---|---|---|---|
| 2,770,448 | A * | 11/1956 | Miller | E21C 27/22 299/59 |
| 2,868,528 | A * | 1/1959 | Cartlidge | E21C 27/22 299/59 |
| 2,878,001 | A * | 3/1959 | Snyder | E21C 27/22 299/59 |
| 3,086,761 | A * | 4/1963 | McWhorter | E21C 27/124 299/57 |

(Continued)

FOREIGN PATENT DOCUMENTS

| | | |
|---|---|---|
| EP | 2821589 A1 | 1/2015 |
| RU | 2319835 C1 | 3/2008 |

(Continued)

*Primary Examiner* — Janine M Kreck
(74) *Attorney, Agent, or Firm* — Corinne R. Gorski

(57) ABSTRACT

A heading machine includes first and second rotating cutting heads each having an axis of rotation extending substantially in a longitudinal direction of the machine, a first cutting roller having an axis of rotation extending substantially horizontal and transverse to the longitudinal direction of the machine, and a further cutting device supported on the cutting frame and arranged to cut off the cusps of unmined material left on side wall. The machine further includes a side stabilizer, and can cut a rectangular profile without leaving cusps left on the side wall.

17 Claims, 8 Drawing Sheets

(56) References Cited

U.S. PATENT DOCUMENTS

| | | | | | |
|---|---|---|---|---|---|
| 3,105,677 | A * | 10/1963 | Brown | E21C 31/08 | 299/59 |
| 3,407,006 | A * | 10/1968 | Brill | E21C 27/22 | 299/59 |
| 4,889,392 | A * | 12/1989 | Justice | E21C 27/22 | 299/18 |
| 5,921,632 | A * | 7/1999 | LeBegue | E21C 31/02 | 299/80.1 |
| 6,305,754 | B1 * | 10/2001 | Uehara | E21C 27/124 | 299/57 |
| 2002/0113484 | A1 | 8/2002 | Schwoebel et al. | | |
| 2010/0270849 | A1 * | 10/2010 | Ebner | E21C 27/22 | 299/58 |

FOREIGN PATENT DOCUMENTS

| | | | |
|---|---|---|---|
| RU | 2627339 | C1 | 8/2017 |
| RU | 2627348 | C1 | 8/2017 |
| SU | 412378 | A1 | 1/1974 |

* cited by examiner

HEADING MACHINE WITH CUSP CUTTER

RELATED APPLICATION DATA

This application is a § 371 National Stage Application of PCT International Application No. PCT/EP2018/052413 filed Jan. 31, 2018.

FIELD OF INVENTION

The present invention relates to a heading machine for cutting mines and tunnels, especially to a borer miner for excavating potash mines. Specifically the mining apparatus excavates material for achieving a required roadway cutting profile.

BACKGROUND

Mechanical cutting is widely used in mining industry. One excavating method is to trim or bore the mine face using rotating cutting heads, drums or rollers to dislodge material from the face, and successively transport the material away in a backwards direction. Such machines tend to leave unmined sections on the roof, floor and/or side wall, these are usually called profile kerfs, gussets or cusps. It is recognized that the cusps left on the side wall, in some mining conditions, can create a risk of the side wall breaking and therefore may, especially in case in an irregular form, cause a hazard to operator working in that area.

US20020113484 describes an apparatus for cutting a bore hole, which includes cutting heads rotating in counter directions, the pair of three-armed cutting heads 52 generates two intersecting circles 1015 (see FIG. 6), the machine includes a smaller cutting head assembly 250 to cut off the upper kerf 1030 (see FIG. 5*a*), the kerf 1060 on the floor is cut off by a plow 350 (see FIG. 1) which is a small horizontal drum type cutter (see [0039]). Further a pair of rotating cutting drums 150 (see FIG. 2, [0035]) is arranged vertically in order to form substantially vertical walls 1010 (see FIG. 6). In such a design, drive means such as a hydraulic cylinder is required to permit extending the drum cutters 152 outwardly from the machine; in addition, material cut by the vertical drum 152 is supposed to be collected by the plow 350 (FIG. 1), i.e. a plow is required; it can be observed that a substantial large corner is left on the floor, and therefore requires significantly larger cutting capacity in order to form a straight wall corner.

U.S. Pat. No. 2,878,001 illustrates an apparatus for chipping coal by overlapping rotary chipping heads 33-40 arranged in four columns and two rows, each cuts a circular profile overlapping one another, referring to FIGS. 6 & 7 and column 5, the upper cusps are removed away by top cusp cutter 92 which is carried by plate 87, and by top cusp cutters 93, 94 which are both carried by plate 88; whereas the cusps on the side wall are chipped by cusp cutters 90, 91 which are arranged respectively on plates 86 and 89, each of these cusp cutters is in the form of teeth which are bent forwardly. Unfortunately, such configuration can hardly be re-used in practice.

It remains a challenge in practice to provide a reliable, high efficiency, safety-improved mining machine.

SUMMARY

It is an objective of the present invention to provide a heading machine that removes the gussets or cusps on the side wall efficiently while having an economical machine structure, which is capable of simultaneously transporting the cut material away in time to satisfy the continuous cutting and conveying requirements, whilst at the same time minimizing the hazard to the operator.

In the subject invention, it is provided an optimal solution for a cutting machine, wherein the machine is equipped with a pair of parallelly arranged cutting rotors having overlapping cutting profiles and a cutting roller having minimised diameter, however the machine is able to form variable, large cutting profiles, especially a substantial rectangular profile without leaving a cusp on the wall. Due to the rectangular profile, this has the advantages that no overlapping cutting area is required in a second pass of cutting.

The objective is achieved by providing a heading machine which is equipped on either side a separate cusp cutter that is dedicated to dislodge cusps on the side wall, this simply removes the risk of breaking of the side wall, therefore achieves a safer environment for operators. It may be conceived that the cusps on the side wall may be removed by a larger sized roller having increased diameter, however a roller having increased diameter becomes much bulkier and heavier, its manufacturing costs also increase significantly, leading to no easy manoeuvrability. Furthermore, the energy consumption will increase in order to drive a much bigger roller. It is far from rational to increase the roller diameter merely aiming for removing a small band of cusp. This is not an economical, energy efficient or environmentally friendly solution. The present invention overcomes these drawbacks. Specifically, the solution in the invention is using a separate cusp cutter in combination with a moderate-sized roller; in addition, due to compact structure of the machine, a cusp cutter should occupy as little space as possible.

According to a first aspect of the present invention there is provided a heading machine including: a travelling mechanism and a cutting frame, wherein the cutting frame carries first and second rotating cutting heads having respectively an axis of rotation extending substantially in a longitudinal direction of the machine, preferably the first and second rotating cutting heads are arranged such that circular areas of respective cutting profiles overlap one another; a first cutting roller supported on the cutting frame and arranged behind the cutting heads, the first cutting roller having an axis of rotation extending substantially horizontal and which transverse to the longitudinal direction of the machine, said axis being spaced apart from the axis of rotation of the cutting heads; a further cutting device is supported on the cutting frame, and is adapted to cut off a cusp of unmined material left on the side wall.

A cusp herein can be understood as a side wall area that is out of reach by the cutting heads and the first cutting roller. It is appreciated that a cusp cutter can be in various forms, either in the form of roller, drum, trimmer chain or trimmer bar, the wording "roller" is used herein as having similar meaning as a drum. The rotating cutting heads are called cutting rotors in one embodiment.

The first cutting roller and the further cutting device are understood as being positioned at the same side in relation to the axis of rotation of the cutting heads. The further cutting device can be installed separately on either side of the machine. Optionally, the further cutting device can be equipped on only one side of the machine. Optionally, the further cutting device can be installed on either top or on bottom of the machine, for example, it can be arranged below and next to the top cutting roller.

In one embodiment, the further cutting device can be a second cutting roller supported on the cutting frame, the second cutting roller having an axis of rotation which is substantially parallel to and located in the rear of the axis of rotation of the first cutting roller, said axis of the second cutting roller is positioned closer to the axis of rotation of the cutting heads in relation to the axis of rotation of the first cutting roller (said axis of the second cutting roller is located between the axis of rotation of the cutting heads and the axis of rotation of the first cutting roller, seen from the front of the machine). The form of the second cutting roller conforms to the form of the first cutting roller, advantageously this makes the second cutting roller suitable for being placed immediately behind and next to the first cutting roller, as there is usually limited space.

Although the second cutting roller is arranged horizontally and transversely, it can also be installed vertically.

In one embodiment, the first cutting roller can be mounted via a roller support onto the cutting frame, the roller support is hinged to the cutting frame in a height-adjustable manner. Such adjustment allows various cutting profiles (profile height) to be obtained, so as to meet various application scenarios and increase the adaptability, besides, it enables the further cutting device to be fastened on the roller support, so that the further cutting device moves along with the first cutting roller.

The second cutting roller may include a plurality of cutting units arranged on its circumference, optionally, a part of the cutting units can have different orientations or cutting directions with respect to the others, optionally, adjacent cutting units may have smaller spacing in the circumferential direction and/or in axial direction than the cutting units on the first cutting roller.

In one embodiment, the heading machine may include a slide guide mounted on the cutting frame or the roller support and arranged substantially parallel to the axis of rotation of the second cutting roller, the second cutting roller is movably coupled on the slide guide and adapted to move along the slide guide. This makes the second cutting roller easily manoeuvrable, as it can be displaced via a cylinder.

Optionally, the machine includes a slide body that is movably coupled on the slide guide, wherein the slide body in turn mounts an individual drive for driving the second cutting roller. The second cutting roller is fixedly coupled to the drive, preferably along the axial direction, by using an individual drive, there is no need to couple to the machine main drive system via otherwise complicated gear. Thus a simpler machine structure is achieved.

Optionally, the machine further includes an actuator mounted on the cutting frame or the roller support for displacing the slide body along the slide guide, preferably the actuator is a hydraulically powered cylinder.

The second cutting roller can have a diameter substantially smaller than that of the first cutting roller. Such a combination of cutting rollers constitutes an economical solution, in comparison to a single roller of larger size.

In one embodiment, as alternative solution, the further cutting device is a chain cutter.

The machine can also include material guiding means mounted on the cutting frame or the roller support for guiding the material cut off by the further cutting device. The material guiding means extends from underside or rear side of the second cutting roller and extends downwards and forwards, it aids the material cut by the cusp cutter to be transferred to the front area and subsequently by the bottom roller and/or together with cutting rotor backward to chain conveyor.

It is a further objective of the invention to keep the machine more stable. During the cutting process, the arm of respective rotor alternately approaches the cut material on the floor. Each contact generates a lateral counter force applied to the machine body, thus the machine rear section tends to swing left and right. This is especially the case when the machine is heavy with gravity centre located at the front and/or when the crawler is short. A side gripper is advantageous to balance the machine. The machine therefore includes a support means mounted at either side of the cutting frame, the support means is adapted to extend outwards and push against the side wall for stabilizing the machine. Keeping the machine rear section stable is advantageous for the measuring system. When a laser scanner is used for guiding the machine and where laser target is mounted on the rear of the frame, unstable lateral movement may cause measurement failure.

Optionally, each support means includes substantially longitudinal contacting structure, one end of which is displaceable in a sideways direction by an actuator, the other end of which is articulated at the cutting frame, preferably the support means (side stabilizer) further includes an expandable or unfoldable cover means. For relocation and for cross cut mining, the function of a side stabilizer can be turned off and the side stabilizer can be pulled back into a parking position. The side stabilizer at its parking position allows good manoeuvrability (retreat or U-turn) of the machine.

Optionally, the machine further includes a pressure regulating circuit for regulating pressure irregularity present in the actuator during operation. The pressure regulating circuit can be further configured to hold the actuator in position upon loss of source input pressure. This helps avoid any damage to the cusp cutter upon the presence of significant counter force.

The first cutting roller may include end portions which are extendible outwards, and has a diameter corresponding to at least one fifth, preferably one fourth, of the cutting diameter of the cutting heads.

The machine can further include a third cutting roller mounted on the cutting frame, preferably the third cutting roller being mounted via a further roller support onto the cutting frame, wherein the further roller support is hinged to the cutting frame in a height-adjustable manner. The third cutting roller can include end portions, which are extendible outwards, and has a diameter corresponding to at least one fifth, preferably one fourth, of the cutting diameter of the cutting heads.

Optionally, each cutting head has at least one radial cutting arm equipped with a cutting section which is movable or extendible in the radial direction, preferably each cutting head has three radial cutting arms, preferably the cutting boom is arranged to be adjustable relative to the travelling mechanism in a vertical direction.

According to a further aspect of the present invention, there is provided a method for excavating material using a heading machine of each embodiment as illustrated above, the method comprising: adjusting the cutting heads and/or the first cutting roller and/or the cutting boom for the purpose of achieving a specific cutting profile, in particular a specific rectangular cutting profile; starting the cutting heads; starting the first cutting roller; starting second cutting roller; conveying the excavated material to the rear side of the machine by a conveyor.

While preferred embodiments of the present invention have been illustrated, and described, it will be understood that changes and modifications may be made therein without departing from the invention in its broader aspects.

BRIEF DESCRIPTION OF DRAWINGS

A specific implementation of the present invention will now be described, by way of example only, and with reference to the accompanying drawings in which.

DETAILED DESCRIPTION

Figure 1:
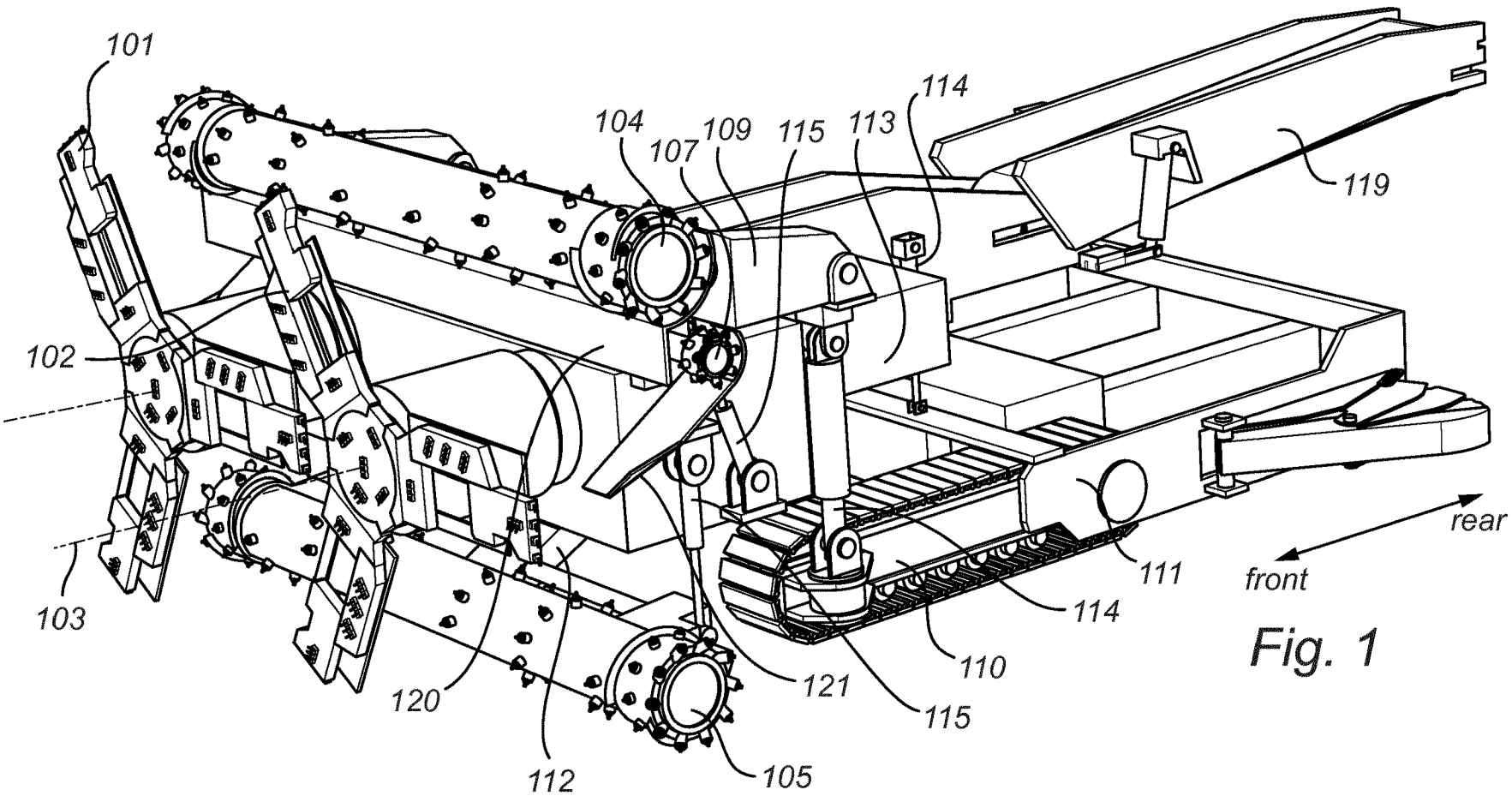
FIG. 1 is a perspective view of a heading machine according to a specific implementation of the present invention.

FIG. 1 shows a heading machine according to a specific implementation of the present invention. The heading machine includes a self-propelled travelling mechanism 110 that may be configured as a crawler mechanism. The travelling mechanism 110 carries, for example via an undercarriage, a machine frame 111 which bears on it a cutting boom 113, which in turn supports a pair of rotary boring heads or called rotating cutting heads 101 and 102 having similar construction. The cutting boom 113 can be adjusted in the vertical direction by an appropriate adjusting apparatus e.g. hydraulic cylinders 114. In particular, the machine is a borer miner.

Figure 3A:
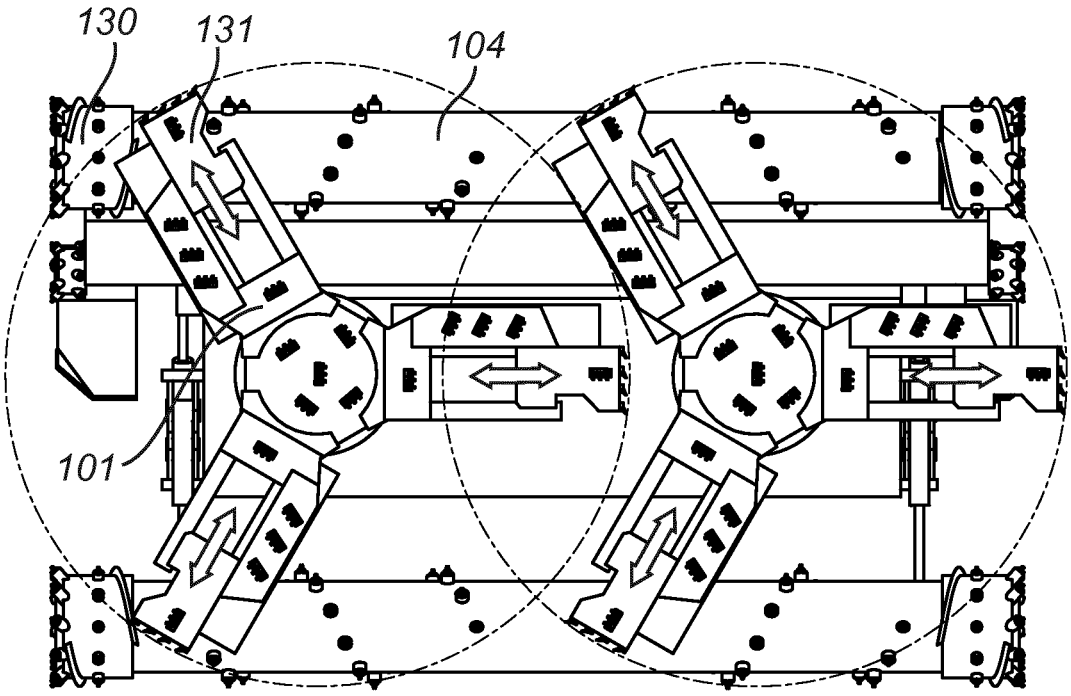
FIG. 3*a* is a front view of a heading machine of FIG. 1.

Referring to FIG. 3*a* and FIG. 1, the pair of rotating cutting heads 101 and 102 are arranged parallelly side by side on the front of the machine, each having a horizontal axis of rotation 103 substantially aligned with the machine direction. The machine direction is indicated to have a front and a rear end as seen in FIG. 1, also being called the longitudinal direction of the machine. Each cutting head is a three-armed (or three-lobe) cutting rotor, bearing individual discrete cutting elements secured thereon, each arm includes scraping/plowing means providing aid in directing excavated material toward the center of machine. Each arm may further include a cutting section 131, which is extendible and retractable in the radial direction. This is indicated by arrows.

Figure 3B:
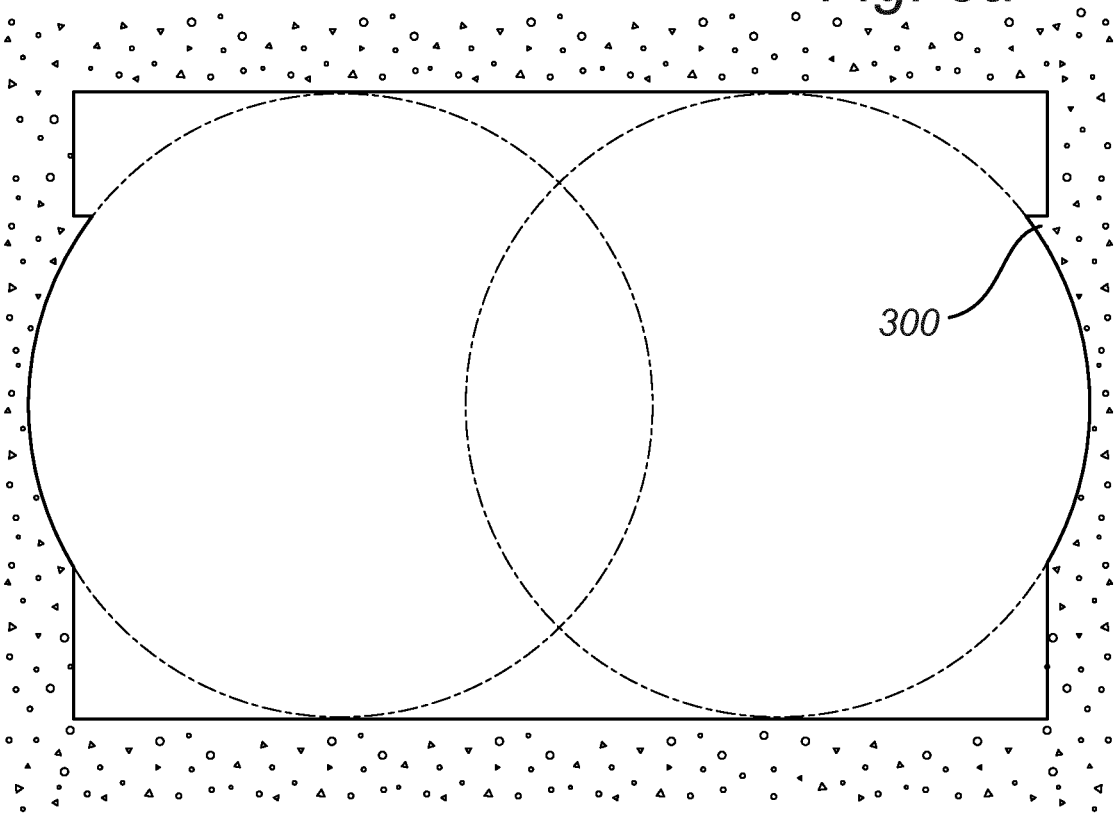
FIG. 3*b* illustrates a cutting profile in a mine face.

The two cutting heads 101 and 102 can be driven in mutually opposite rotation directions in a synchronized manner, with the individual cutting arms accordingly engaging with each other during rotation so as to produce the overlaps of the individual circular profiles (as shown in FIG. 3*b*).

Although three-armed rotary cutting heads 101 and 102 are described, it should be understood that boring heads having other configurations could be utilized. Any configuration of rotary boring head such as a two-armed boring head or the like, can be used.

Figure 4:
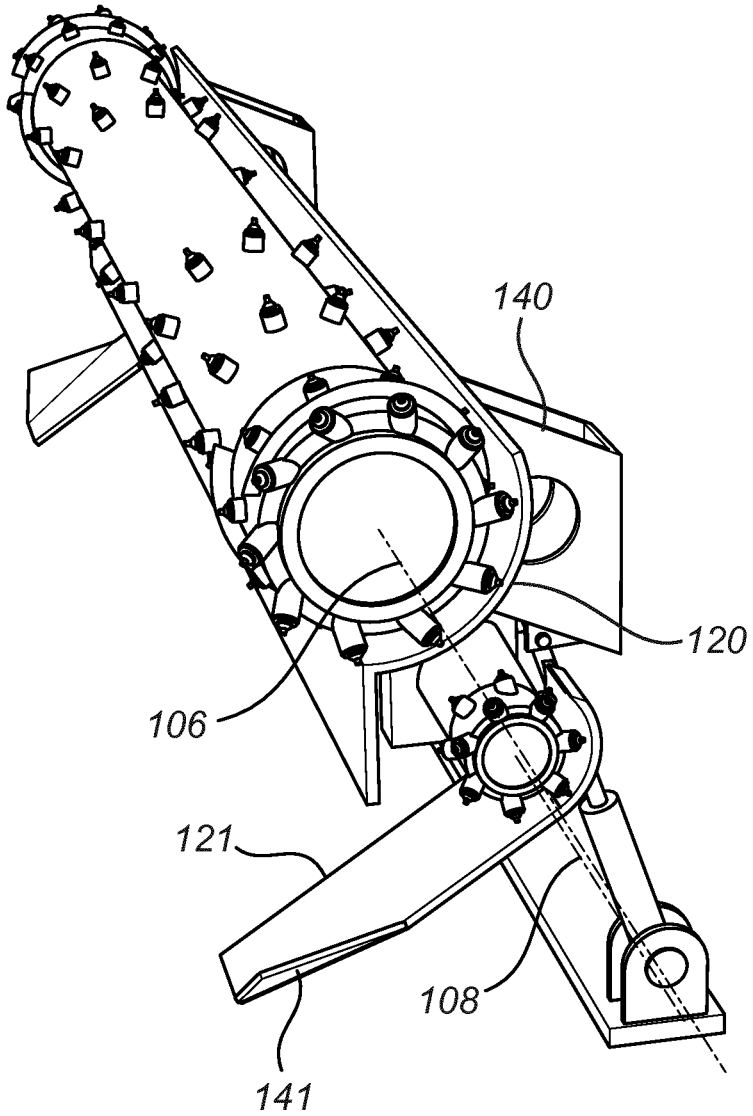
FIG. 4 is a perspective view of a top cutting roller together with a cusp cutter.

In FIG. 1 can be seen that the heading machine further includes a pair of pivotable roller support arms 109 and 112 mounted on the machine frame 111 or cutting boom 113. On the distal end of the roller support arms cutting rollers 104 and 105 are mounted. Each cutting roller has a horizontal axis of rotation 106, transverse to the machine direction, as can be seen in FIG. 4. The roller support arms 109, 112 are pivotable about a horizontal transverse axis respectively, driven by hydraulic cylinders 115, so that the cutting rollers are raised or lowered relative to the machine frame 111 or cutting boom 113, respectively. The cutting rollers 104 and 105 are driven by a hydraulic or electric motor via a gear mechanism. The cutting rollers 104 and 105 can have a cylindrical form, and each may include an extendible end section 130 that is connected with the central portion of the cutting roller by the aid of a positive connection in a manner secured against rotation, yet displaceable in the direction of the axis of rotation of the cutting roller. A first material guiding means 120 is arranged in connection to the upper cutting roller 104. The material guiding means is arranged in parallel to the cutting roller, thus being transversely arranged in relation to the machine direction.

A plurality of cutting units are mounted on the rotary cutting heads 101 and 102 and on cutting rollers 104 and 105, spaced apart in a specific pattern. For example, on the circumference of the cutting rollers it may be a spiral or series of spirals, or a helical pattern. The cutting units are arranged in a specific orientation, for example projecting forwardly outwardly, and may deflect to certain extent in axial direction and/or radial direction. The cutting units may be in any form, having cutting tools such as picks, bits, inserts, teeth, discs, wedges and the like secured on a tool holder or seat. The cutting tools such as bits may be made of a material that is more wear resistant than the tool holder or the seat.

FIG. 1 further shows a hauling device 119, for example, a chain conveyor, which extends in the longitudinal direction of the machine beyond the end of the machine frame 111 for discharging the excavated material in the rear.

The machine includes a further cutting roller 107 in form of a cusp cutting roller/drum. It is arranged immediately behind and below the top cutting roller 104. In order to reduce the interference from the cut material falling from the top cutting roller, it is arranged immediately behind and below the transversely arranged first material guiding means 120. The guiding means 120 is mounted to the roller support arms 109, for guiding the material dislodged by the top cutting roller downwards and/or forwards. Material cut off by the cusp cutter 107 is guided by a second material guiding means 121 which extends downwards and preferably forwards.

In FIG. 4 can be seen the second material guiding means 121 having an inclined flank 141 to facilitate collection of falling material, a support beam 140 secured to material guiding means 120 extends backwards in order to carry the cusp cutter 107. The second cutting roller has an axis of rotation 108 which is substantially parallel to the axis of rotation 106 of the first cutting roller 104.

Figure 5:
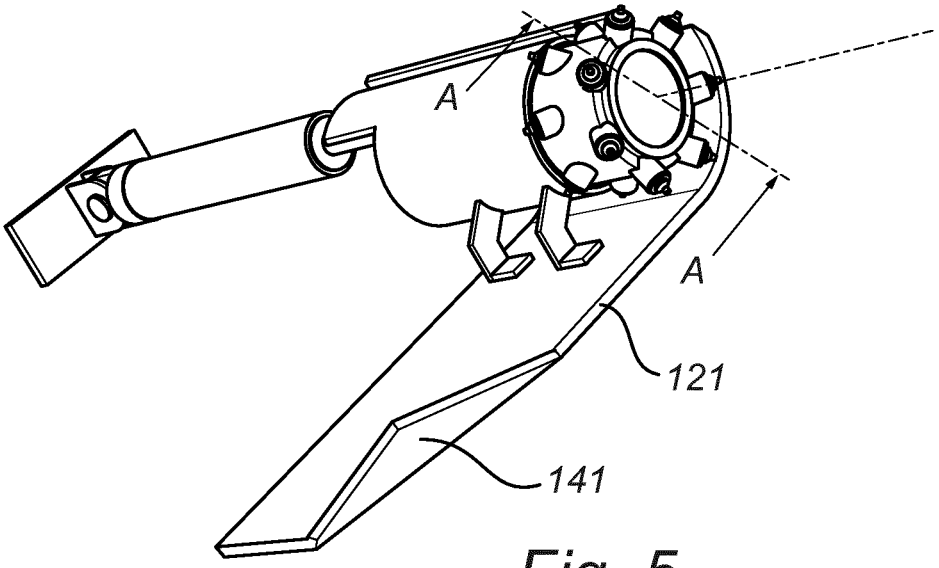
FIG. 5 is a perspective view of a cusp cutter arrangement according to a specific implementation of the present invention.
Figure 6:
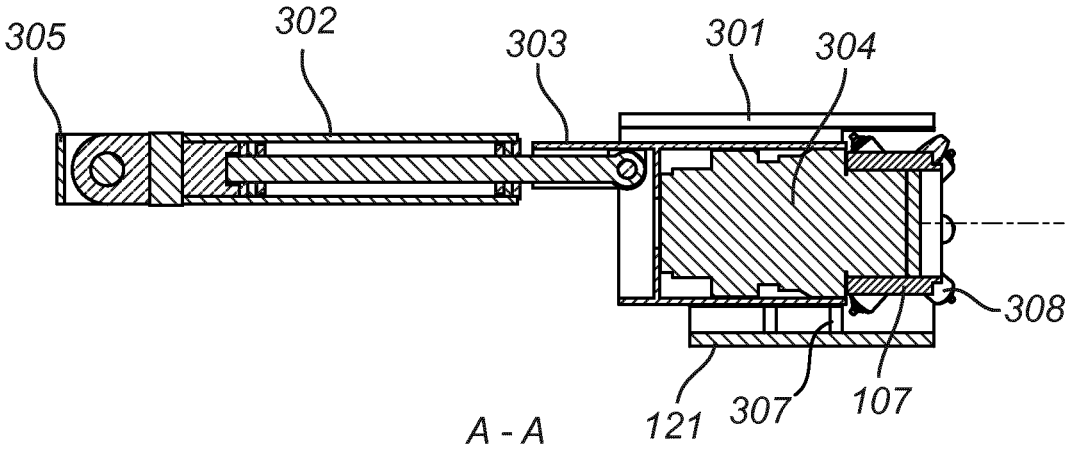
FIG. 6 is a cross sectional view through A-A of FIG. 5.

FIG. 5 gives a perspective view of a cusp cutter, a cross sectional view through A-A is shown in FIG. 6, a seat 305 and a slide guide 301 are firmly secured to a support beam 140, as seen in FIG. 4. The slide body 303 is movably engaged or embedded onto the slide guide 301, the slide body 303 carries a hydraulic motor 304, to which a cusp cutter 107 is coupled, so as to be driven by it. The cusp cutter 107 includes a plurality of cutting units 308. The characteristic and layout of cutting units 308 are similar to that illustrated with regard to the cutting roller 104, except that the size of the cutting units and spacing between adjacent cutting units 308 may be smaller than those on the cutting roller 104. The cusp cutter 107 has a diameter corresponding to one fifth to one half, preferably in the range of one third, of the diameter of the cutting roller 104. A material guiding means 121 is included and mounted via interface 307 to the slide body 303. A hydraulic cylinder 302 interconnects the slide body 303 to the seat 305, upon actuation, the cylinder 302 displaces the slide body 303 laterally.

As in the subject invention, the rotary cutting heads 101 and 102 as well as the cutting rollers 104 and 105 are displaceable in an upward/downward direction. The cutting diameter of the rotary cutting heads 101 and 102 is adjustable due to the presence of radially movable section 131 on each arm. Furthermore, the end portions 130 of the cutting rollers 104 and 105 are laterally extendible and retractable. The combination of these characteristics enables variable sized cutting profiles with variable width and/or height to be formed, and it also enables a substantially rectangular profile to be cut.

Advantageously, the machine can be configured such that only small size cusps 300 are unmined by the rotors and top roller on the side wall that is suitable for being cut away by the cusp cutter, as seen in FIG. 3*b*. The result may be in a band with width and height of around 150 cm, but also other dimensions might be relevant. The machine can also be configured such that no annoying cusp is left on the bottom side.

Figure 2A:
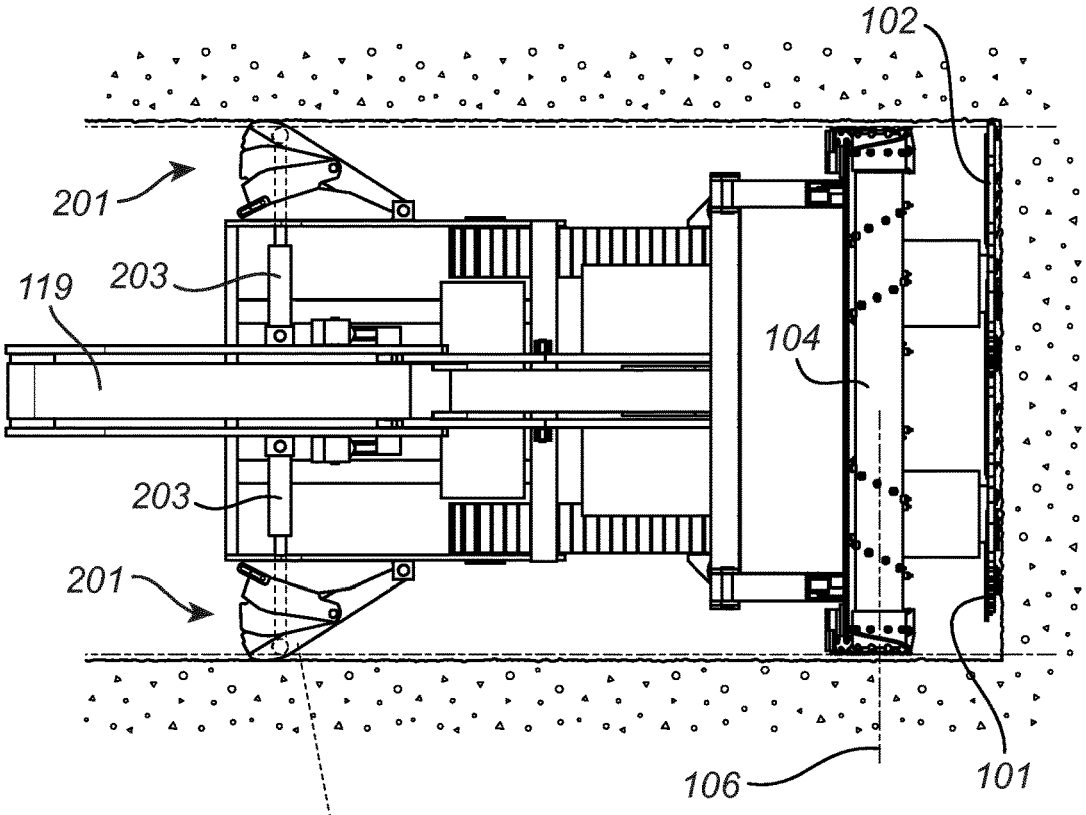
FIG. 2*a* is a plan view of a heading machine of FIG. 1.
Figure 2B:
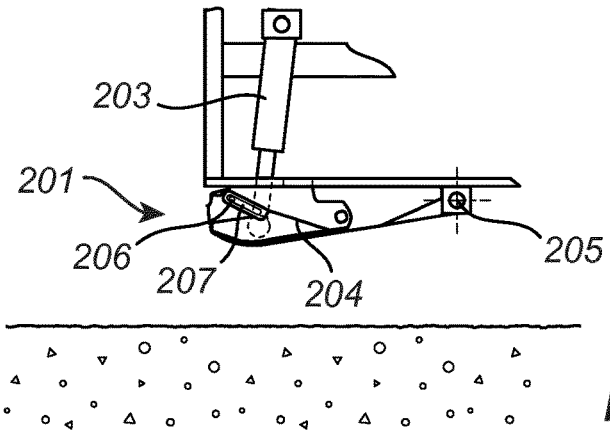
FIG. 2*b* is a magnified plan view showing a side stabilizer in its park position.
Figure 2C:
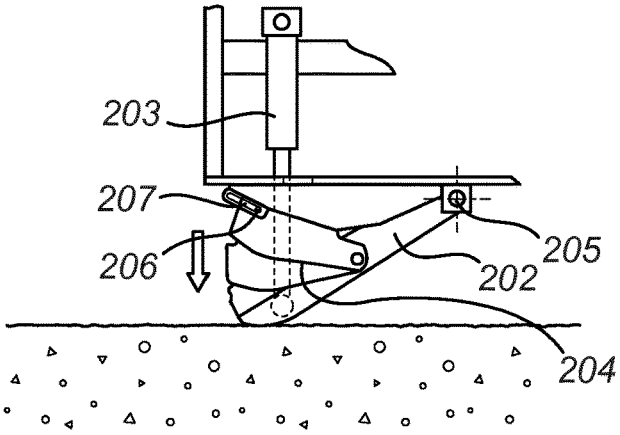
FIG. 2*c* is a magnified plan view showing a side stabilizer in its work position.

Referring to FIGS. 2*a* to 2*c*, on the rear side of the machine frame, there is provided a side stabilizer or gripper 201 arranged on either side. The side stabilizer includes a beam 202 that is pivotably coupled at its one end via a pivot 205 to the machine frame, the other end of the beam 202 is connected to the piston rod of a cylinder 203. The beam 202 can be moved outwardly by the cylinder 203 into gripping contact with the side wall. When not in use, cylinder 203 is in its retracted position, the side stabilizer 201 is rested in its park position (FIG. 2*b*). The side stabilizer 201 as shown in FIG. 2*c* is illustrated in its work position, where the piston rod of cylinder 203 has been extended to push the beam 202 against the side wall.

In order to deck the area exposed above the extended cylinder, a cover 204 is introduced, this increases safety to operators upon approaching this area, it also protects the cylinder from the falling material. The cover 204 can be a set of covering plates superimposed on each other, one end of the plates is articulated at a joint at approximately longitudinal center of the beam 202. The plates at the rear end may be strung together via chains. An upper plate at its rear end has a pin 206 that is engaged within the slot of the buckle 207, which is fixed on the machine frame. When the side stabilizer 201 is in its park position, the covering plates are stacked up. And when the cylinder 203 extends to its work position, the plates may be brought to spread out.

Figure 8:
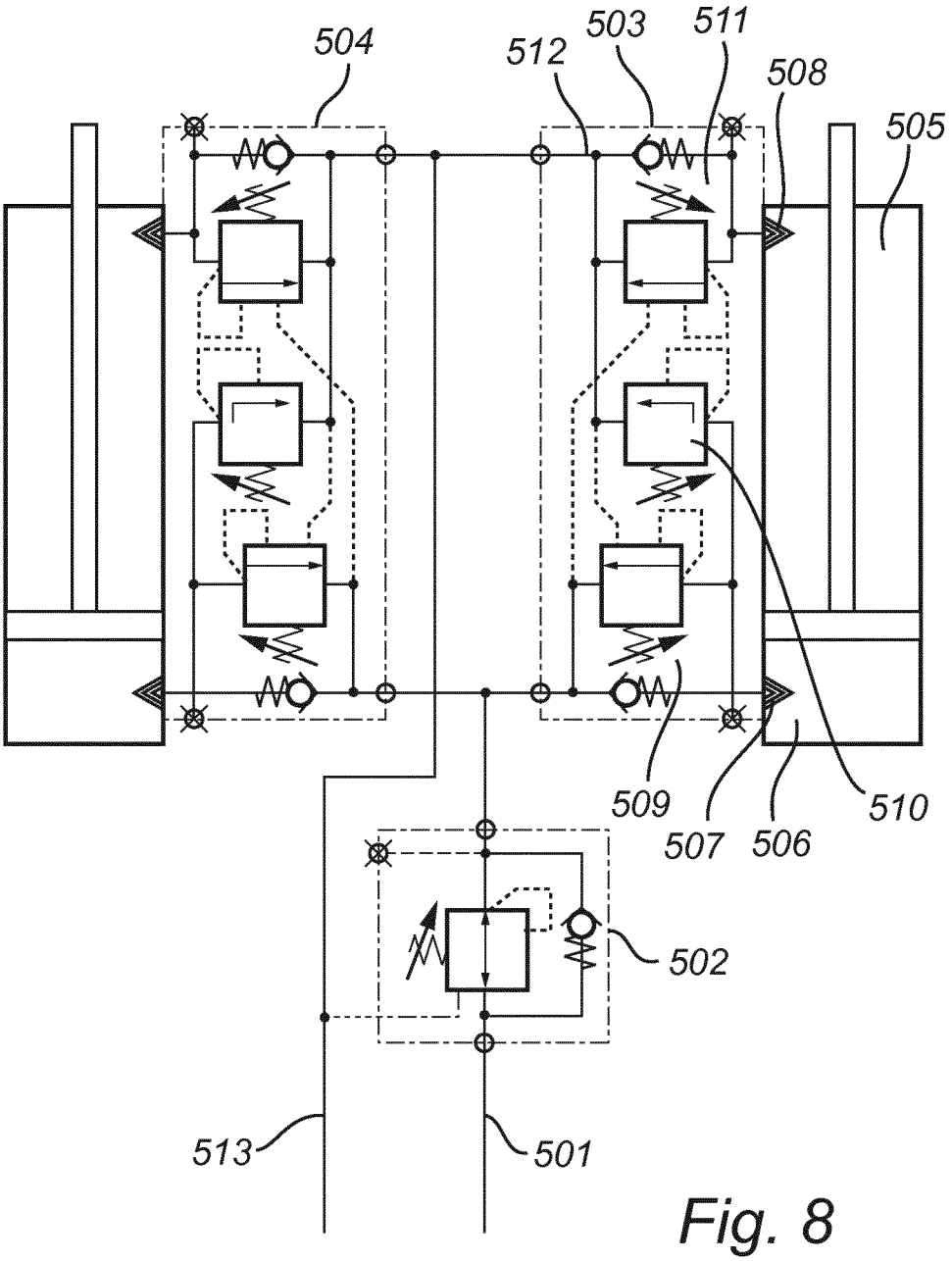
FIG. 8 is a schematic view of the fluid control system for a cusp cutter according to a specific implementation of the present invention.

FIG. 8 gives a schematic view of the fluid system for a cusp cutter, wherein the symmetrical circuit for two cusp cutters is illustrated. Both right and left side are symmetrical and each half can serve for a single cusp cutter. Fluid supply from an inlet conduit 501 is regulated by a pressure reducing valve 502, which is for example set to 35 bar, thus allows a maximal value of e.g. 35 bar to pass to a valve assembly 503. A check valve is included in the pressure reducing valve 502 in order to bypass the fluid from the opposite direction during retracting of the cylinder.

The valve assembly 503 can be directly mounted on the cylinder, and includes a first counter balance valve 509, a second counter balance valve 511 and a pressure relief valve 510, having fluid communication with the pressure reducing valve 502, and with cylinder chambers 505 and 506, with a circuit of another cusp cutter, and also with a drain/reservoir. Fluid from the pressure reducing valve 502 is directed via the first counter balance valves 509 to the cylinder chamber 506, said valve 502 also in fluid communication with an external pilot port of the second counter balance valve 511 enabling to open said valve 511 and thereby allow the release of pressure from the chamber 505 during the extension of cylinder. The return port of second counter balance valves 511 is in fluid communication with the external pilot port of the first counter balance valves 509 enabling to open said valve 509 for the purpose of retracting the cylinder. The counter balance valves 509 and 511 are able to hold the cylinder in position when the system loses input pressure from a source.

The pressure relief valve 510 serves to regulate pressure irregularities or anomalies present in the cylinder during operation, in particular, to relieve pressure peaks or shocks that appear constantly during cutting. The cylinder chamber 506 is fluidly connected to the load port of pressure relief valve 510 which is internally piloted. A predetermined set pressure for said valve 510 is chosen such that the cusp cutter is not to be damaged, for example it may be 50 bar. Once the cusp cutter encounters a larger external passive load from the rock strata, i.e. corresponding pressure at the port 507 exceeding the predetermined set pressure, the pressure relief valve 510 opens and allows the pressure to relieve, fluid may flow to port 508 or may be drained via conduit 513, or may flow to a valve assembly 504 associated with another cusp cutter, so as to relieve the pressure inside the cylinder, until the pressure reaches the pressure relief valve's reseating pressure.

The set pressure may be predefined and adjustable on the basis of mining conditions. The pressure reducing valve 502, the pressure relief valve 510, first counter balance valve 509 and second counter balance valve 511 have in turn increment setting values. The value for the pressure reducing valve 502 enables constant pressure to be applied to the cusp cutter.

Figure 9:
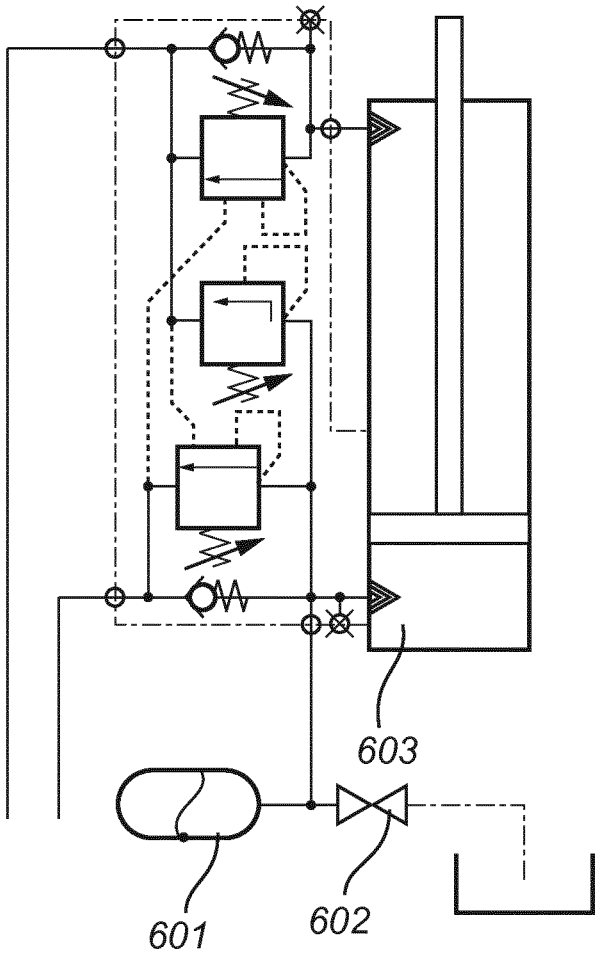
FIG. 9 is a schematic view of the fluid control system for a side stabilizer.

For the side stabilizer, the hydraulic supply control includes a circuit similar to that of cusp cutter, as shown in FIG. 9. The control circuit incorporates an accumulator 601 which is charged when the side stabilizer is active, and which serves to maintain required pressure in the cylinder chamber 603 for a substantially longer time. The ball valve 602 allows manual release of fluid pressure of the accumulator 601. The predetermined set pressure associated with the pressure relief valve is smaller than that of counter balance valves. The predetermined set pressure is much greater in relation to that of the cusp cutter.

Advantageously, the configuration helps avoid damage to the machine and the side wall against too large active and passive forces.

In operation, firstly, the machine may be set up with various configuration if required, for example by setting the cutting boom 113 to appropriate height by adjusting the group of cylinders 114; adjusting the extendible end sections 131 of the rotor arms if needed depending on the required cutting profile dimension; starting the chain conveyor 119; starting motors in turn for left/right rotors, motor for the top roller, motor for the bottom roller, motor for the cusp cutter;

adjusting extendible end sections 130 of the cutting rollers 104 and 105; adjusting the cusp cutter to intended position; finally starting tramming and advance the machine. After the cutting job is done, the reverse processes are carried out.

Figure 7:
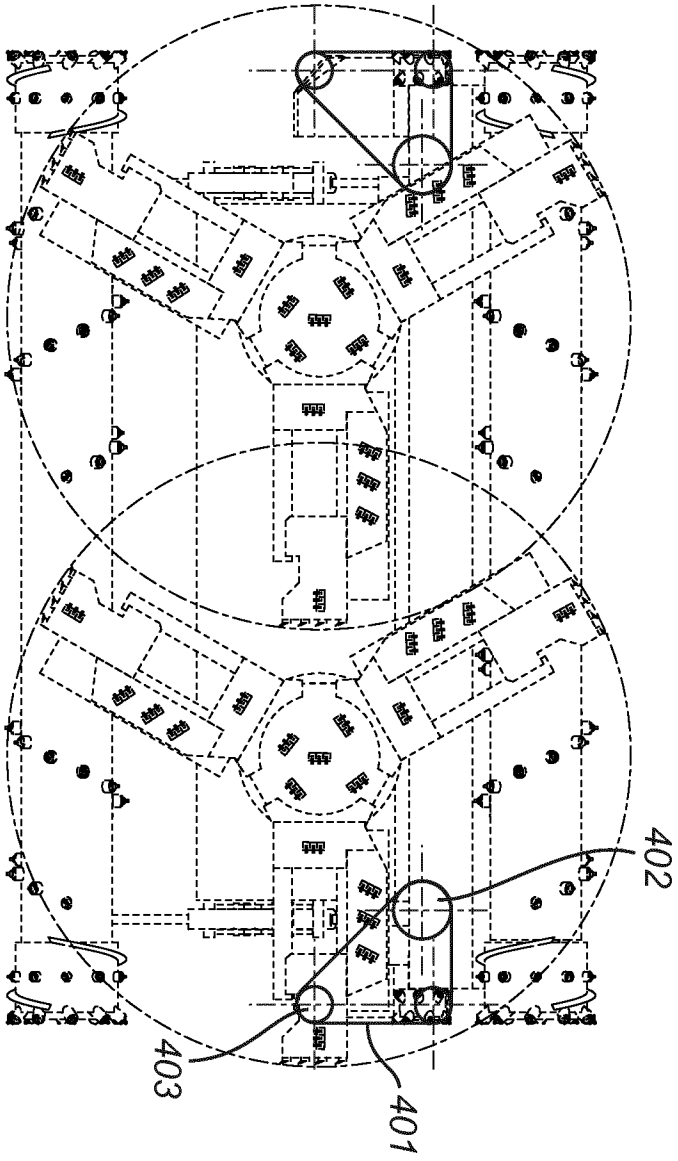
FIG. 7 is a front view of a heading machine according to a further specific implementation of the present invention.

In accordance with another implementation of the present invention, there is provided an alternative solution to using a chain cutter to replace a roller cusp cutter. Other machine components are the same as the embodiment illustrated above, except that the cusp cutter is substituted by a trimmer chain/chain cutter. The layout of the chain cutter is shown in FIG. 7. Such a cusp cutter includes an endless chain 401 carrying the cutting elements thereon. Said chain cutter is powered by a hydraulic or electric motor 402, and is guided and deflected by a set of sprockets 403. A pair of chain cutters are installed laterally spaced apart on either side, and driven by an individual drive 402. It is understood that the chain cutter may be arranged on a movable or slide structure in order to change its lateral or vertical position. The separate chain loops (left and right cusp cutters) can be integrated as a single chain cutter. The chain cutter is positioned immediately behind the cutting roller 104. The chain loop plane can be positioned in a substantially vertical plane, positioning in a horizontal plane is also possible when sufficient space for installation is available. Cutting blocks having cutting picks may be coupled in series via connectors to construct a chain 401. Cutting picks may be such as picks, bits, inserts, teeth, discs, wedges and the like.

The heading machine can be used in the mining industry for cutting mines and tunnels, especially for excavating a coal mine or a potash mine.

The invention claimed is:

1. A heading machine comprising:

a travelling mechanism and a cutting frame, wherein the cutting frame carries first and second rotating cutting heads having respectively an axis of rotation extending substantially in a longitudinal direction of the machine, the first and second rotating cutting heads being arranged such that circular areas of respective cutting profiles overlap one another;

a first cutting roller supported on the cutting frame and arranged behind the cutting heads, the first cutting roller having an axis of rotation extending substantially horizontal and transverse to the longitudinal direction of the machine, said axis being spaced apart from the axis of rotation of the cutting heads; and a cutting device supported on the cutting frame and arranged to cut off a cusp of unmined material left on a side wall, wherein the first cutting roller includes end portions that are extendible outwards, and wherein the first cutting roller and the cutting device are positioned at a same side in relation to the axis of rotation of the cutting heads.

2. The heading machine according to claim 1, wherein the cutting device is a second cutting roller supported on the cutting frame, the second cutting roller having an axis of rotation which is substantially parallel to and located at the rear of the axis of rotation of the first cutting roller and is positioned closer to the axis of rotation of the cutting heads in relation to the axis of rotation of the first cutting roller.

3. The heading machine according to claim 2, wherein the first cutting roller is mounted via a roller support onto the cutting frame, the roller support being hinged to the cutting frame in a height-adjustable manner.

4. The heading machine as claimed in claim 3, further comprising a slide guide mounted on the cutting frame or the roller support, the slide guide being arranged substantially parallel to the axis of rotation of the second cutting roller, wherein the second cutting roller is movably coupled on the slide guide and arranged to move along the slide guide.

5. The heading machine as claimed in claim 4, further comprising a slide body movably coupled on the slide guide, wherein the slide body in turn mounts an individual drive for driving the second cutting roller.

6. The heading machine as claimed in claim 5, further comprising an actuator mounted on the cutting frame or the roller support for displacing the slide body along the slide guide, wherein the actuator is a hydraulically powered cylinder.

7. The heading machine according to claim 6, further comprising a pressure regulating circuit for regulating pressure irregularity present in the actuator during operation, the pressure regulating circuit being configured to hold the actuator in position upon loss of input pressure.

8. The heading machine according to claim 2, wherein the second cutting roller includes a plurality of cutting units arranged on its circumference, at least a part of the cutting units having different orientations or cutting directions than the others.

9. The heading machine as claimed in claim 2, wherein the second cutting roller has a diameter substantially smaller than that of the first cutting roller.

10. The heading machine as claimed in claim 2, further comprising a material guiding means mounted on the cutting frame or the roller support, extending from underside or rear side of the second cutting roller and extending downwards and forwards for guiding the material cut off by the cutting device.

11. The heading machine according to claim 1, wherein the cutting device is a chain cutter.

12. The heading machine as claimed in claim 1, further comprising a support means mounted at either side of the cutting frame, wherein the support means is arranged to extend outwards and push against the side wall for stabilizing the machine.

13. The heading machine according to claim 12, wherein each support means includes a substantially longitudinal contacting structure, one end of which is displaceable sidewards by an actuator, an other end of which is articulated at the cutting frame, preferably the support means further including an expandable or unfoldable cover.

14. The heading machine as claimed in claim 1, wherein the first cutting roller has a diameter corresponding to at least one fifth of the cutting diameter of the cutting heads.

15. The heading machine as claimed in claim 1, further comprising a third cutting roller mounted on the cutting frame, wherein the third cutting roller is mounted via a further roller support onto the cutting frame, the further roller support being hinged to the cutting frame in a height-adjustable manner, the third cutting roller including end portions that are extendible outwards, and has a diameter corresponding to at least one fifth of the cutting diameter of the cutting heads.

16. The heading machine as claimed in claim 1, wherein the cutting frame includes a cutting boom, the cutting heads being supported by the cutting boom, and wherein each cutting head has at least one radial cutting arm equipped with a cutting section which is movable or extendible in the radial direction, wherein each cutting head has three radial cutting arms, the cutting boom being arranged to be adjustable relative to the travelling mechanism in a vertical direction.

17. A method for excavating material using a heading machine as claimed in claim 1, the cutting frame including a cutting boom, the cutting heads being supported by the cutting boom, the method comprising:

adjusting the cutting heads and/or the first cutting roller and/or the cutting boom for achieving a specific cutting profile, such as a specific rectangular cutting profile;

starting the cutting heads;

starting the first cutting roller;

starting the second cutting roller; and conveying the excavated material to the rear side of the machine by a conveyor.

* * * * *